US007290750B2

(12) United States Patent
Huber et al.

(10) Patent No.: US 7,290,750 B2
(45) Date of Patent: Nov. 6, 2007

(54) CONCRETE FORMING APPARATUS FOR FOUNDATION PIER BLOCKS AND A METHOD FOR CONSTRUCTING PIER BLOCKS

(75) Inventors: Donald G. Huber, P.O. Box 64160, Tacoma, WA (US) 98464; Terry Hartman, Bonney Lake, WA (US)

(73) Assignee: Donald G. Huber, Tacoma, WA (US)

( * ) Notice: Subject to any disclaimer, the term of this patent is extended or adjusted under 35 U.S.C. 154(b) by 535 days.

(21) Appl. No.: 10/665,743

(22) Filed: Sep. 19, 2003

(65) Prior Publication Data

US 2004/0093824 A1 May 20, 2004

Related U.S. Application Data

(60) Provisional application No. 60/445,120, filed on Feb. 4, 2003, provisional application No. 60/412,717, filed on Sep. 19, 2002.

(51) Int. Cl.
*E04G 13/00* (2006.01)

(52) U.S. Cl. ..... 249/91; 249/48; 249/51; 249/61; 249/94; 249/96; 249/97; 249/117; 249/134; 249/188

(58) Field of Classification Search ..... 52/415–441, 52/294–299, 319, 327, 328, 414, 333–337, 52/404.1, 405.1, 421–422, 432; 264/45.1, 264/46.4, 219, 239, 34, 35, 41, 138, 139; 249/48, 51, 61, 91, 117, 134, 188, 94, 96, 249/97, 143

See application file for complete search history.

(56) References Cited

U.S. PATENT DOCUMENTS 1,233,848 A * 7/1917 Dowsett et al. ..... 249/117
2,276,422 A * 3/1942 Siemer ..... 249/184
2,397,728 A * 4/1946 Lyttelton et al. ..... 249/50
2,451,112 A * 10/1948 Niccolls ..... 249/194
3,021,586 A 2/1962 Uruburu ..... 25/121
3,024,512 A * 3/1962 Dyer ..... 249/51
3,428,287 A 2/1969 Redding et al. ..... 249/13
3,486,341 A * 12/1969 Huesker-Stiewe et al. .... 405/18
4,385,745 A 5/1983 Bennett ..... 249/41
4,659,054 A 4/1987 Allen ..... 249/7
4,673,157 A 6/1987 Wells ..... 249/13
4,767,241 A 8/1988 Wells ..... 405/239
5,635,097 A 6/1997 Aiello ..... 249/38
5,785,459 A 7/1998 Swinimer ..... 405/237

(Continued)

*Primary Examiner*—Jeanette Chapman
(74) *Attorney, Agent, or Firm*—David L. Garrison; Merchant & Gould

(57) ABSTRACT

The current invention discloses moisture resistant foundation pier block forms constructed from corrugated plastic. Means for holding sections of reinforcing bar can be included and at least one preferred embodiment of the invention includes means for securing the form in its desired location at a construction site. The forms of the current invention are light weight and can be easily assembled at a construction site or at a remote location. Sections of reinforcing bar can be inserted in at least one preferred embodiment of the invention during assembly and the forms can then be folded into a flat configuration for storage until needed. The forms disclosed in the current invention can be reused, but they do not attract insects and therefore do not have to be removed from the pier blocks after the concrete has dried.

12 Claims, 6 Drawing Sheets

U.S. PATENT DOCUMENTS 5,800,727 A 9/1998 Croghan ..... 249/51
6,279,281 B1 8/2001 Lee ..... 52/335
6,543,742 B2 4/2003 Wells ..... 249/34

* cited by examiner

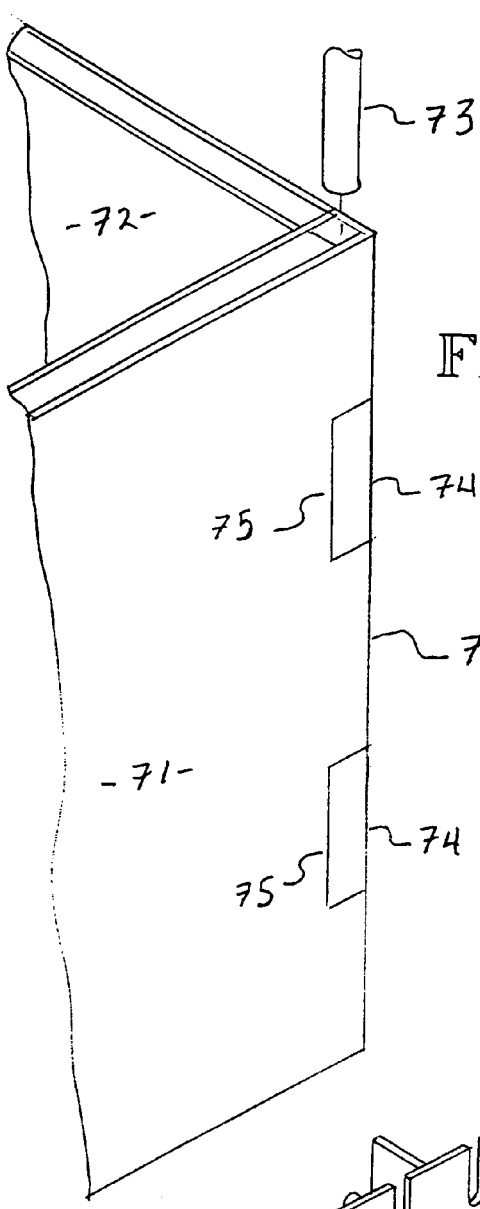
FIG. 11
FIG. 12
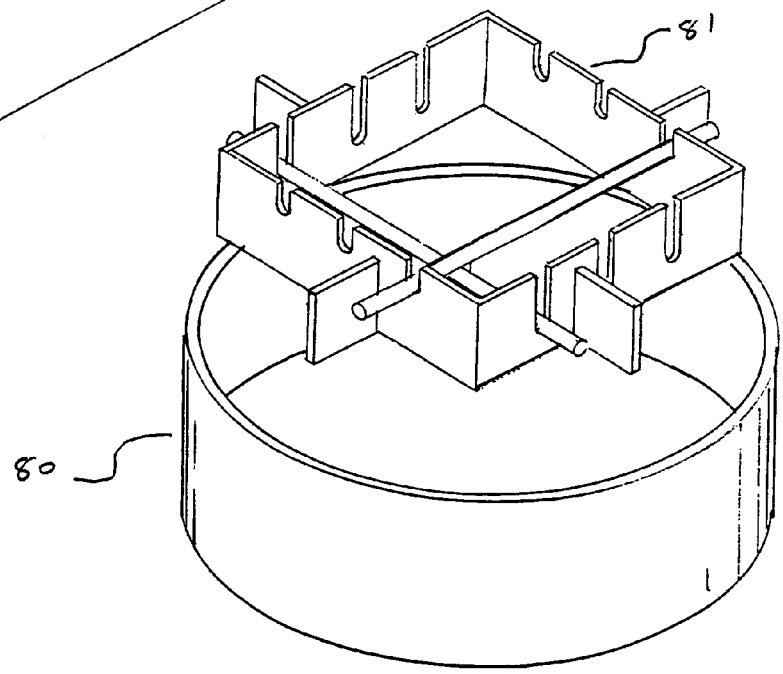

CONCRETE FORMING APPARATUS FOR FOUNDATION PIER BLOCKS AND A METHOD FOR CONSTRUCTING PIER BLOCKS

This application claims the benefit of U.S. Provisional Application Ser. No. 60/412,717, entitled Concrete Forming Apparatus for Foundation Pier Blocks, filed Sep. 19, 2002 and U.S. Provisional Application Ser. No. 60/445,120, entitled Concrete Forming Apparatus for Foundation Pier Blocks, filed Feb. 4, 2003.

TECHNICAL FIELD

The invention relates to a form for constructing pier blocks from poured concrete, for use in building construction. In particular, this invention describes a lightweight and collapsible form for pier blocks and a method for constructing pier blocks.

BACKGROUND OF THE INVENTION

Poured concrete foundations for buildings have been used for many years. Pier blocks can be used as one part of a concrete foundation for buildings. Pier blocks are used to support columns or other weight bearing vertical members of a structure.

Typically pier blocks are constructed in two stages. The first stage is the preparation of a form that is the desired size and shape of the pier block, and the second stage is pouring concrete into the form to make the pier block.

One type of form used for pouring concrete pier blocks is constructed from wood. Such forms are usually constructed on the building site and making these forms can consume a significant amount of time. After the concrete inside these forms has set, they must be removed from the pier block so that the pier block can be inspected and so as not to attract insects. The wood used for these forms is usually contaminated with concrete and thus is generally unsuitable for use elsewhere in the building.

Consequently, when constructing pier blocks using conventional wood forms, there is a significant amount of labor required for constructing the forms and stripping the forms after the concrete has set, and there is also a high wastage of the form material once it is stripped from the concrete. The resulting expense from the required labor and the wastage can be quite sizable on large construction projects.

Cardboard forms have been used for pier blocks in an attempt to reduce wastage of wood and the amount of labor required. Typical embodiments of cardboard forms can include cardboard tubes and box or rectangular forms made from cardboard. While cardboard forms can reduce wastage and the amount of labor required, this reduction comes with significant drawbacks.

Because some building codes require that forms be inspected before concrete is poured into them, forms are typically put in place before the concrete arrives on the construction site. In some cases, the forms can remain in place for days before concrete is poured into them. While leaving cardboard forms in place on dry soil in dry weather conditions has no adverse effect on such forms, damp ground, dew, and rain can severely degrade the forms and adversely affect their ability to hold wet concrete. Additionally, commercially available cardboard forms do not have any provisions for holding reinforcing bars within the interior of the form and the forms are difficult to remove once the concrete has set.

Because cardboard is not rigid, the walls of the form tend to bulge outward when concrete is poured into the form. If the form is damp, the bulging deformation can be uneven or non uniform and the pier block will have an non uniform shape and non uniform coverage of any reinforcing bars placed in the form.

Another type of bulging can occur where the top of the form bulges out further than the bottom of the form causing the surface area at the top of the pier block to be greater than the surface area of the bottom of the block, thereby increasing the volume of concrete required to construct the pier block. When this type of bulging occurs, the bulged areas of the pier block bear little weight of any structure resting on the pier block because they are not in contact with the ground.

In some locations, the cardboard can attract insects such as termites that could ultimately infest the building. To prevent such insect problems, many local building codes require all cardboard to be removed from pier blocks. Oftentimes large quantities of cardboard remain stuck to pier blocks after the form has been stripped off and significant labor is required to remove it. Thus, while cardboard forms do have some advantages over conventional wood forms, wastage caused by having to replace forms ruined by moisture and the labor required to remove all cardboard from the finished pier blocks can result in unanticipated expenses.

As more and more governments update their respective building codes, the number of locations that require pier blocks to be reinforced with steel is growing. Steel reinforcement generally takes the form of reinforcing bars that are placed in the form in such a manner that the wet concrete completely covers the reinforcing bars. When using wood or cardboard forms, some type of stand is generally required to hold the reinforcing bars in place while the concrete is being poured. Placing the stand so that it will hold the reinforcing bars in the desired location within the form requires additional labor and some degree of skill.

Thus, there exists a need for a form used for the construction of concrete pier blocks that is easy to assemble, resistant to the effects of moisture, capable of holding reinforcing bars in a desired location, and does not need to be removed from the pier blocks once they have set. Such forms that are light weight, collapsible, easily stored and easily transported would be significant improvements over the prior art.

DISCLOSURE OF THE INVENTION

Accordingly, it is an object of this invention to provide an easily assembled prefabricated form for the construction of concrete foundation pier blocks.

Another object of this invention is to provide such forms that are resistant to the effects of moisture.

Yet another object of the invention is to provide such forms that can be easily anchored in a desired location on a construction site.

A further object of this invention is to provide such forms that are capable of holding reinforcing bars in a desired location within the form.

It is also an object of this invention is to provide forms, for constructing concrete pier blocks, that do not need to be removed from the pier blocks once the concrete has hardened.

A yet further object of this invention is to provide forms that are light weight, collapsible, easily stored and easily transported.

The invention overcomes the disadvantages of the prior art by providing a form which is prefabricated at a remote location and can be quickly installed on a construction site for considerably less cost than wood forms. The forms disclosed herein are resistant to moisture so it can be used in a greater variety of climates than cardboard forms.

Additionally, the forms disclosed herein may be self reinforced such that there is little or no deformation of the forms when concrete is poured into them. When the walls of the form are not reinforced to prevent deformation, the forms will deform in a uniform manner under the hydrostatic pressure of wet concrete and the resulting pier block will have a round cross section.

The forms disclosed herein are constructed of light weight corrugated plastic. Corrugated plastic is well-known material having two parallel facing sheets and spaced, integral interconnecting ribs between the facing sheets. The plastic sheet material can be easily extruded from a variety of plastic resins such as polyethylene, polypropylene, and the like. This material is also referred to as fluted plastic. However, for the purpose of this invention any reference to corrugated plastic is a reference to a material comprising two parallel facing sheets of some plastic composite, having spaced, integral interconnecting ribs between them.

In their collapsed configuration the forms disclosed herein are easily stored and transported. Once on the construction site, the forms disclosed herein are easily assembled and put into place.

Because they are constructed of corrugated plastic, the pier block forms disclosed herein will not attract insects and can therefore be left on the finished pier block. However, most of the forms of the current invention can be reused and need not be left on the finished pier block.

According to the disclosure herein forms can be provided in a number of embodiments. One preferred embodiment is a rectangular or square shaped form comprised from a single piece of corrugated plastic. The corners are formed by seams that are at right angles to the long axis of the walls. This embodiment folds flat for storage and is easily assembled at the construction site.

Another embodiment comprises two elongated pieces of corrugated plastic. Each piece has a seam at a right angle to the long axis of the piece. The pieces can be folded at the seam so that each piece of plastic then comprises two walls of a square or rectangular form. Each piece of plastic is scored near each end of the long axis so that tabs and slots formed by the scoring can be used to connect the two pieces to create the pier block form. The pieces used to construct the form in this preferred embodiment can have additional scoring, for tabs and slots, at a predetermined distance from each end of the long axis so that smaller pier block forms can be created.

Another preferred embodiment of the forms disclosed herein invention comprises four elongated pieces of corrugated plastic. The pieces of this embodiment are scored with tabs and slots in a manner similar to the two-piece embodiment described above, and assembly is accomplished in the same manner as described above. As with the two-piece form described above, the pieces used to construct the form in this preferred embodiment can have additional scoring, for tabs and slots, at a predetermined distance form each end of the long axis so that smaller pier block forms can be created.

One embodiment of the invention comprises four walls having slots at each end of the long axis of each wall. The form is assembled by mating the slots on each wall with the slots on the two adjacent walls.

At least one preferred embodiment of the forms disclosed herein comprises a cylindrical piece of corrugated plastic.

Another preferred embodiment of the invention comprises a single strip of corrugated plastic having tabs and slots so that the ends of the strip can be joined to create a cylindrical form. The strips of this embodiment can be scored at evenly spaced locations along the long axis of the strip to provide slots, so that the size of the form can be adjusted. Additionally, if a larger cylindrical form is desired, two of the strips of this embodiment can be joined together.

Various preferred embodiments of the invention can include flanged portions that run parallel to the long axis of the walls of the form. In at least one preferred embodiment, these flanged portions are an extension of the walls of the form, with a seam in the material defining the flange. In another preferred embodiment, the flanges are separate pieces of corrugated plastic that are connected to the walls of the form by tab and slot connection. In at least one preferred embodiment, the flanges include slots for holding reinforcing bars. Additionally, at least one preferred embodiment of the forms disclosed herein has stake holes in the flanges so that stakes may be used to hold the form in place.

At least one preferred embodiment of the forms disclosed herein uses clips inserted into slots in the walls of the form for holding reinforcing bars. Other preferred embodiments of the invention use reinforcing bars holders that are hooked over the sides of the walls of the form. Another preferred embodiment of the invention includes holes in the walls of the form for holding reinforcing bars in place.

At least one preferred embodiment of the forms disclosed herein includes reinforcing bar holders that are inserted into slots located in the two walls adjacent to each corner of the form. Other preferred embodiments of the forms disclosed herein include a separate reinforcing bar holder that is placed inside the form. Other embodiments of the invention include tabs for holding reinforcing bars. The tabs can be a separate piece of corrugated plastic that is fastened to the interior wall of the form, or the walls of the form can be scored to create tabs that can be pushed into the interior of the form. The tabs each have a hole, notch, slot, or recess for securing the sections of reinforcing bar. In at least one preferred embodiment of the invention, sections of reinforcing bar can be inserted into an assembled form, and the form can then be folded and stacked for storage or transportation to a construction site.

Some embodiments of the invention include horizontal strips at the top edge for stiffening the form so that minimum deformation of the form occurs when concrete is poured into it. Other embodiments of the forms disclosed herein include vertical stiffening strips on the side of the form, and some embodiments have both vertical and horizontal stiffening strips.

To use the current invention, a builder simply assembles the forms at the construction site by either folding the one piece forms into the desired shape, or using the tabs and slots to assemble the multi-pieced forms into the desired shape. If desired the forms can be staked to the ground at their desired location and reinforcing bars can be positioned in the forms using the appropriate reinforcing bar holding means. Concrete is then poured into the forms and allowed to set. While the forms can be reused, there is no need to remove the forms after the concrete has set.

The forms disclosed in the current invention are lightweight, easily transported, easily stored, easily assembled, and easily used. They are less expensive than forms constructed from wood, and they are moisture resistant, unlike forms constructed from cardboard. The forms disclosed in the current invention do not attract insects, so they do not have to be removed from the finished pier blocks. The forms disclosed in the current invention can be used to hold reinforcing bars in place while pouring concrete.

BRIEF DESCRIPTION OF THE DRAWINGS

The objects and features of the present invention, which are believed to be novel, are set forth in the appended claims. The present invention, both as to its organization and manner of operation, together with further objects and advantages, may best be understood by reference to the following descriptions, taken in conjunction with the accompanying drawings wherein:

FIG. 11 is a perspective view showing the tab and notch connection for the form side walls of one preferred embodiment of the pier block forms disclosed herein.

FIG. 12 is a perspective view of another preferred embodiment of a pier block form according to the disclosure herein.

BEST MODE OF CARRYING OUT THE INVENTION

Figure 1:
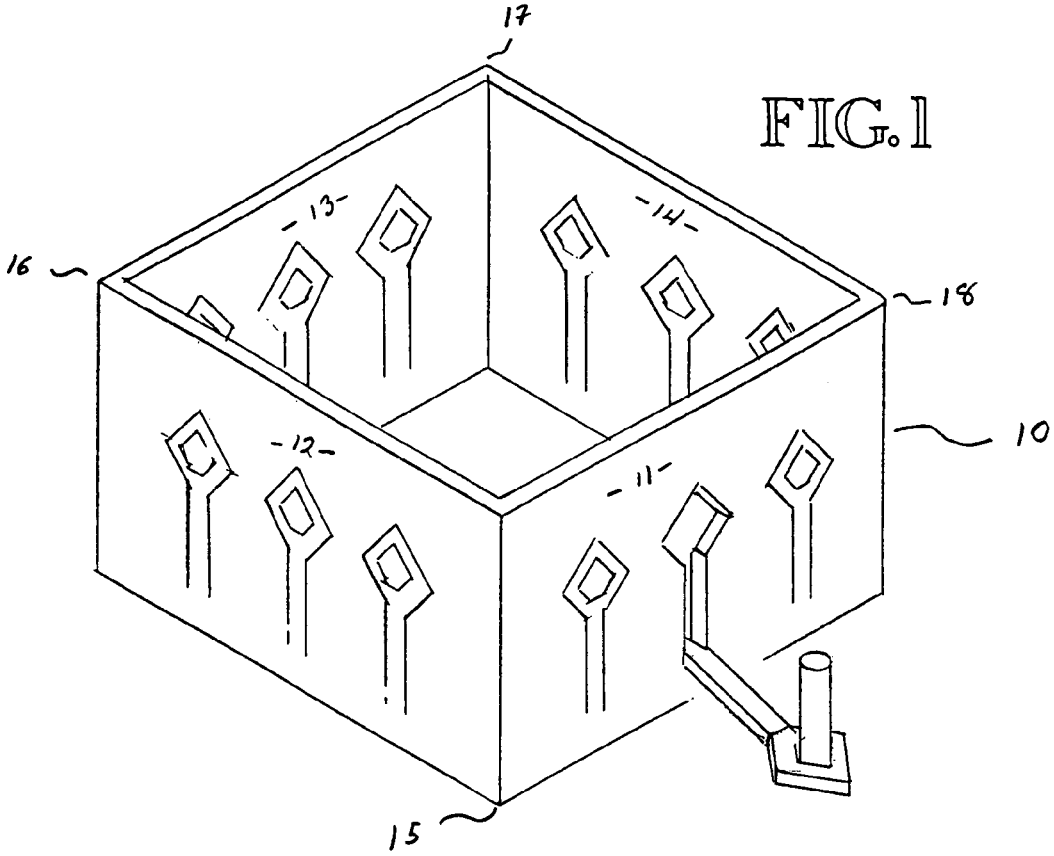
FIG. 1 is an elevated perspective view of one preferred embodiment of a pier block form of the current invention.
Figure 2:
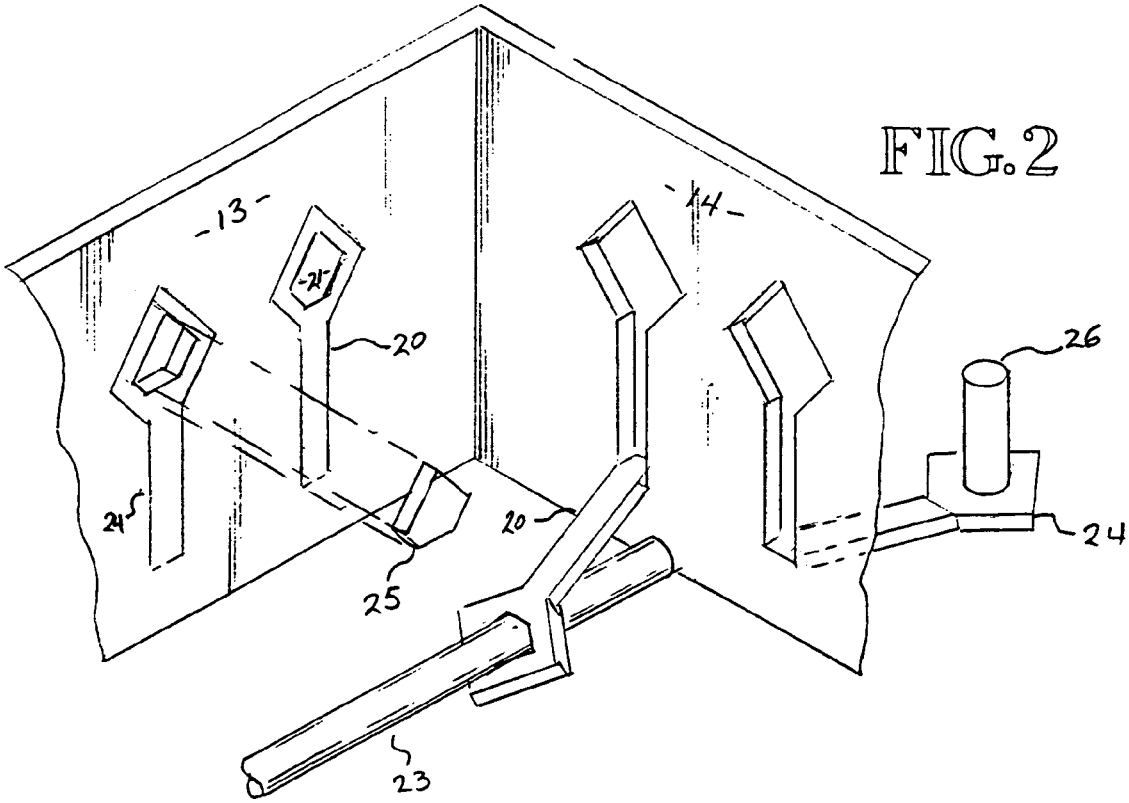
FIG. 2 is an exploded view of the reinforcing bar tabs and the anchor stake tabs of the pier block form shown in FIG. 1.
Figure 3:
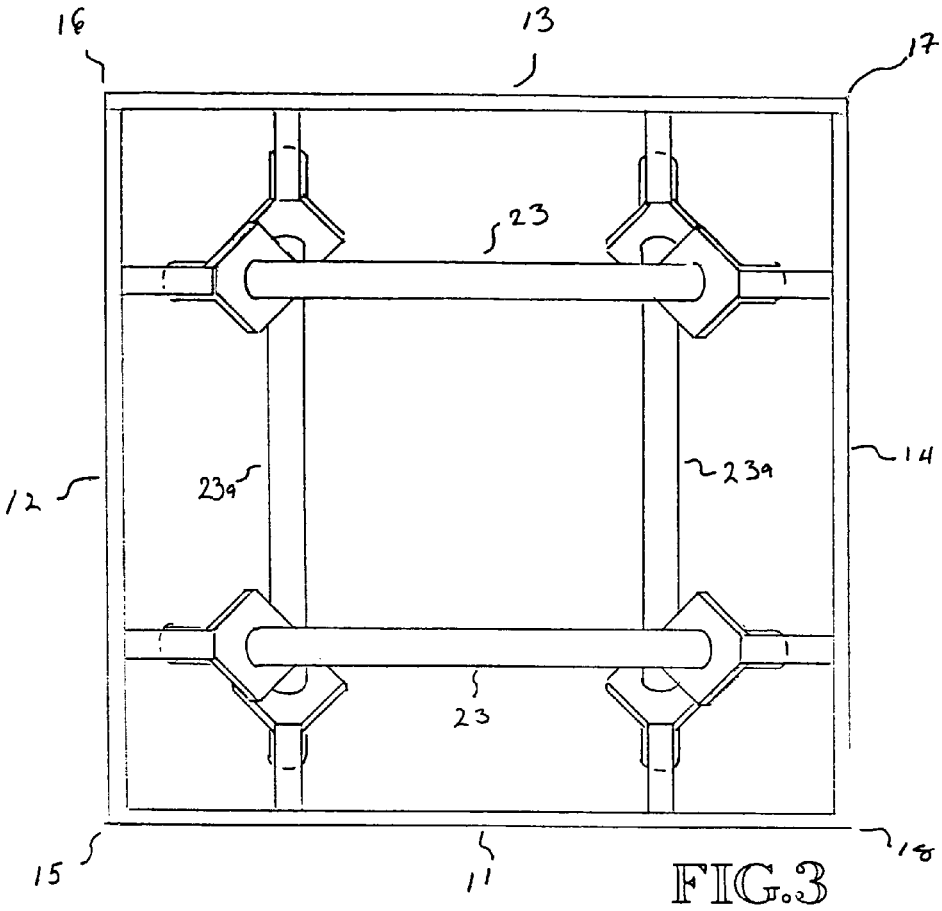
FIG. 3 is plan view showing the placement of reinforcing bar sections in the pier block form of FIG. 1.
Figure 4:
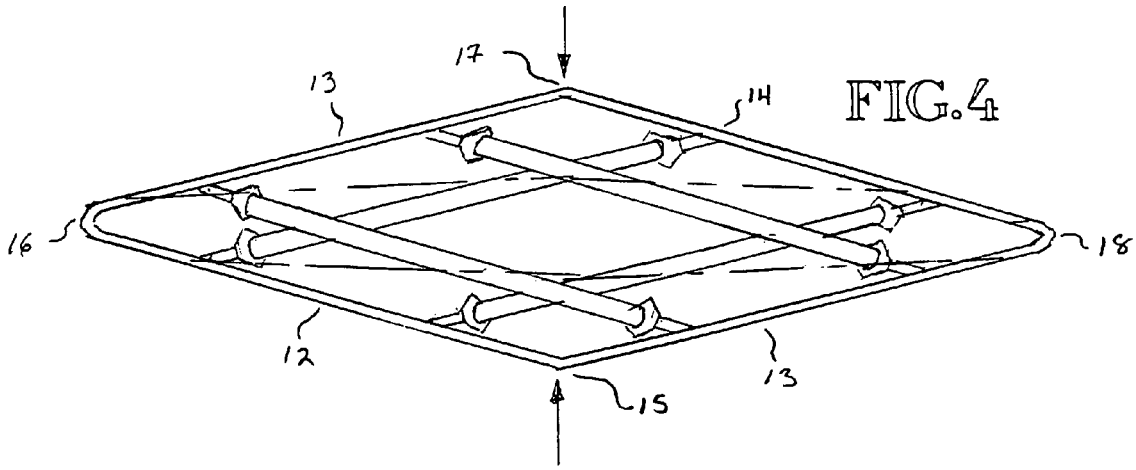
FIG. 4 is plan view showing the pier block form of FIG. 1 being folded while sections of reinforcing bar are secured within the interior of the form.

Turning now to the drawings, the invention will be described in preferred embodiments by reference to the drawings wherein like numbers indicate like parts.

Shown in FIG. 1 through FIG. 4 is a preferred embodiment of a pier block form 10 that is constructed from a single, elongated piece of corrugated plastic wherein the two free ends are connected to each other using an adhesive material such as construction glue or the like. The free ends of the form can also be connected by tab and slot connecters or interlocking slots (described in more detail below)

The pier block form has four substantially planar side walls 11, 12, 13, & 14 each having a long axis and a short axis. The corners 15, 16, 17, & 18 of the form are defined by folds/seams in the corrugated plastic material that run at right angles to the long axis of walls. The walls of the form are scored to provide a plurality of reinforcing bar tabs 20 and anchor stake tabs 24, and the tabs are further scored to provide insertion holes for reinforcing bars and anchor stakes.

In its unassembled state, two corners 15, 17 are urged inward such that the interior surface of walls are in contact with the interior surfaces of adjacent walls and the form 10 is folded flat. To assemble the form, a user simply pulls the corners 15, 17 outward until the form is in its desired shape. If desired, reinforcing bars 23 can be inserted by pushing the reinforcing bar tabs 20 into the interior of the form and pushing the corrugated plastic material 21 out of the scored area on the tabs, thereby creating reinforcing bar insertion holes. When reinforcing bars are used, the form will have a first plurality of reinforcing bars 23 spanning the width of the interior of the form 10 in one direction, and a second plurality of reinforcing bars 23*a* spanning the width of the interior of the form in another direction below the first plurality of reinforcing bars 23.

After the reinforcing bars have been inserted, the form can be folded to a flat configuration by urging a pair of opposing corners 17, 15 toward the interior of the form. The reinforcing bars 23, 23*a* will remain in the interior of the form and the form can then be stacked with other forms for storage or transportation to a construction site.

When using the form on a construction site, a user pulls the corners 15, 17 outward until the form is in its desired shape and places it in the desired location. If desired, the form can be anchored in position by pushing the scored anchor stake tabs 24 to the exterior of the form and removing the plastic material 25 from the scored area on the tab 24 to create an anchor stake insertion hole. An anchor stake 26 is then inserted into the hole and driven into the substrate below the form. The form can then be left in its desired location for an extended period of time with no adverse effects from the elements of nature. While not shown in the drawings, the anchor stake tabs 24 can also be pushed into the interior of the form such that the anchor stake will be covered by concrete if this is desired.

Figure 13:
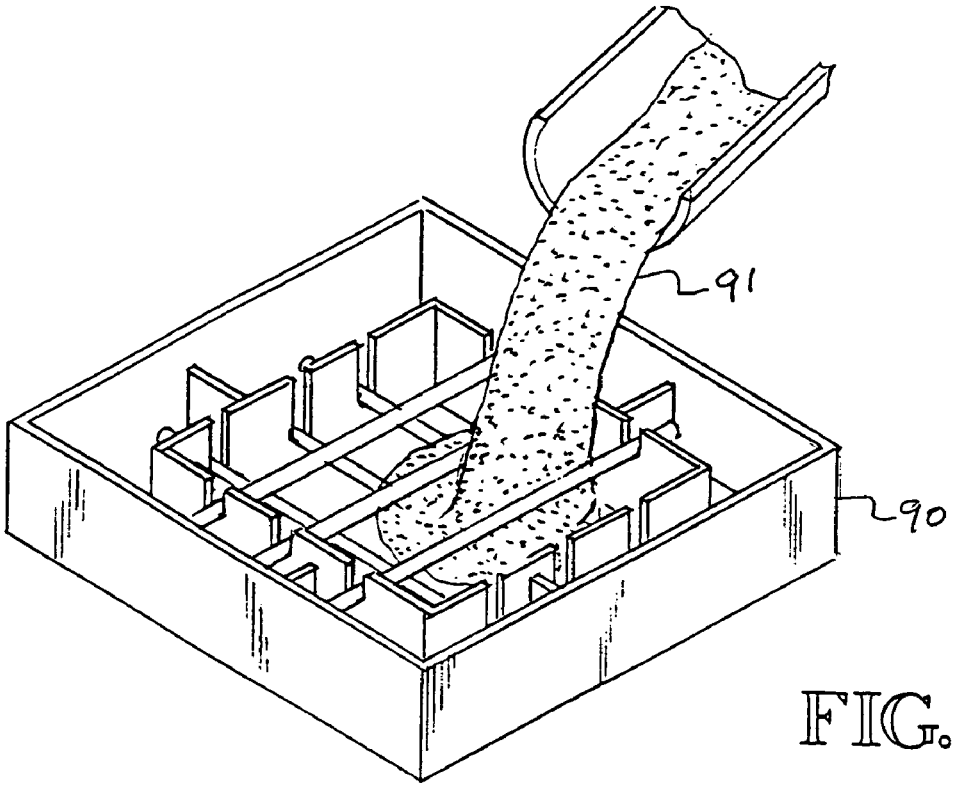
FIG. 13 is a perspective view of concrete being poured into a pier block form according to the disclosure herein.

Pier blocks are constructed by pouring concrete into the interior of the form (shown generally in FIG. 13). Although not shown in the drawings, the forms disclosed herein can have reinforcing stiffener strips attached to the exterior of the form side walls to prevent deformation, or reinforcing members can be placed inside the form side walls. The stiffening strips or stiffening members are constructed from material having sufficient strength to resist deformation under the hydrostatic pressure of the wet concrete in the form, and are attached to the form or placed in the form side walls such that they are parallel to the form side walls.

Figure 14:
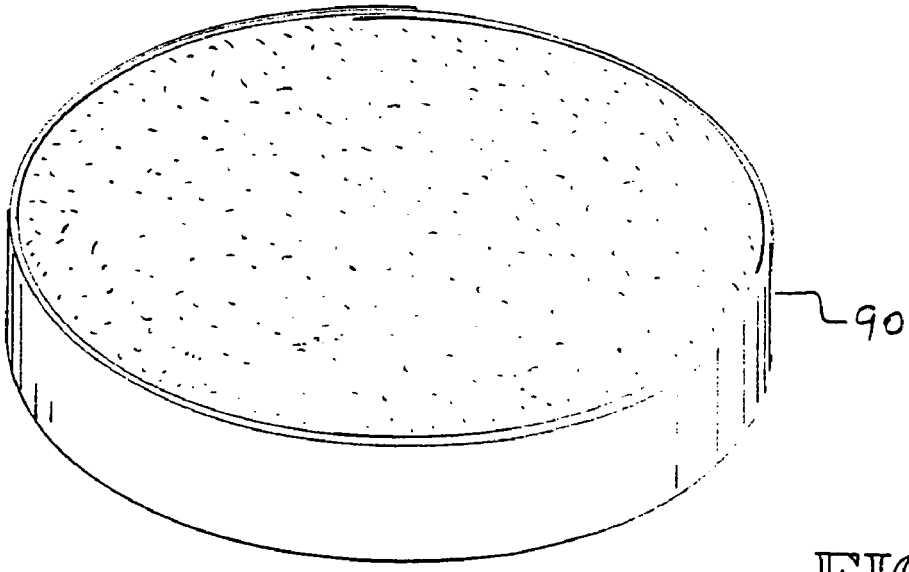
FIG. 14 is a perspective view showing the uniform deformation of a pier block form after concrete has been poured into the form.

If stiffening members or strips are not used, the hydrostatic pressure of the concrete in the form will cause uniform deformation such that the pier block will have a circular or round cross section (generally shown in FIG. 14). Because the form is constructed from corrugated plastic, it will not attract insects and there is no need to remove the form from the pier block once the concrete has hardened. However, the forms of the current invention can be reused and need not be left on the finished pier block.

Figure 5:
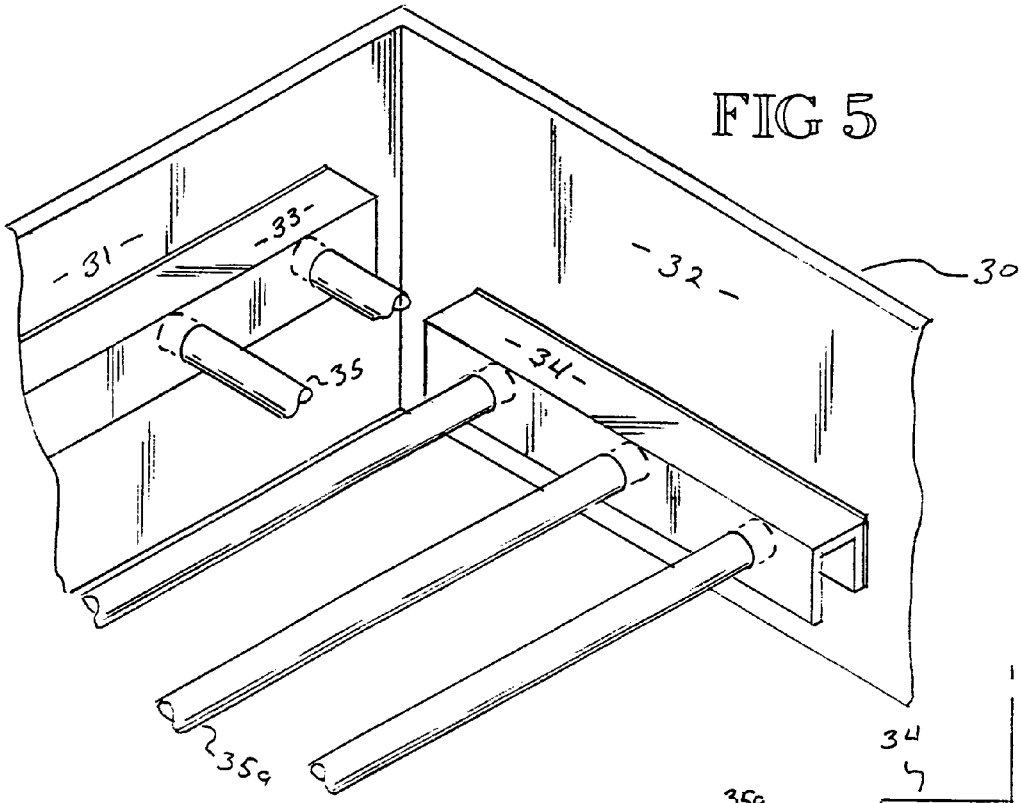
FIG. 5 is a perspective view showing another preferred embodiment of a reinforcing bar holder for the forms of the current invention.
Figure 6:
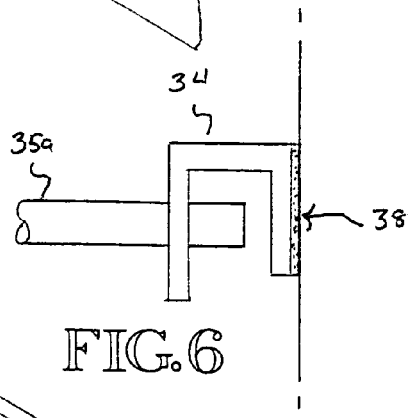
FIG. 6 is a side view of the reinforcing bar holder of FIG. 5.

Referring to FIG. 5 and FIG. 6, there is shown another embodiment of a corrugated plastic pier block form 30 having reinforcing bar support panels 33 & 34 attached to the side walls 31 & 32 of the form, The panels are constructed from a single piece of corrugated plastic and they have a generally U-shaped cross section, created by folds in the piece of corrugated plastic. One panel is attached to each sidewall in the form with the base of the U facing the top of the form. The interior leg of the U-shaped panel has a plurality of reinforcing bar insertion holes for placement of reinforcing bars within the interior of the form.

The panels of this embodiment are attached to the form side walls with an adhesive material (shown generally as 38) such as construction glue or the like. The panels 33, 34 are attached to the side walls such that when reinforcing bars are placed within the form 30, the reinforcing bars 35 in one of the panels 33 extends across the interior of the form 30 at a higher level than the reinforcing bars 35*a* in the other panel 34.

Figure 7:
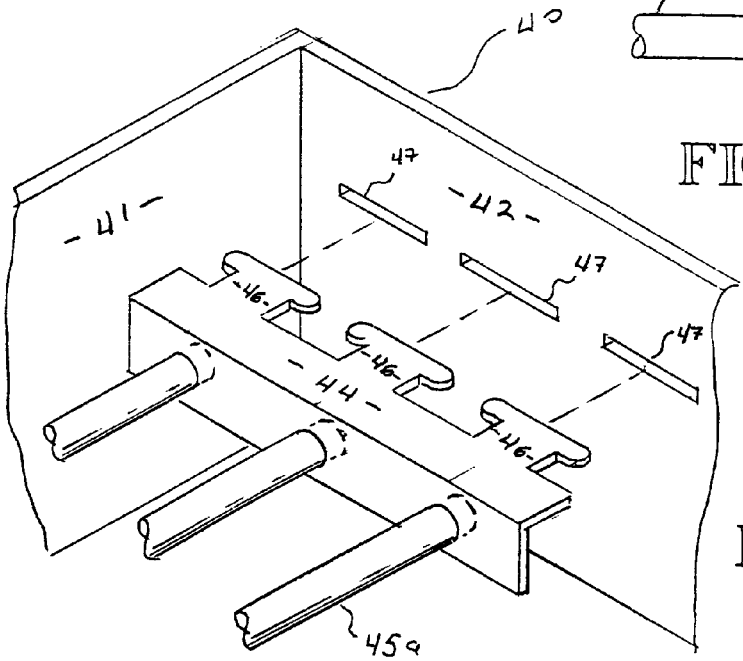
FIG. 7 is a perspective view showing tab and slot connection of a reinforcing bar holder according to the disclosure herein.

FIG. 7 shows a form 40 with another embodiment of a reinforcing bar support panel 44. The panels are constructed from a single piece of corrugated plastic and they have a generally L-shaped cross section, created by a fold/seam in the piece of corrugated plastic. The corrugated plastic material on the long stem of the L-shaped panel 44 is cut to form a plurality of tabs 46, and the walls of the form 40 are cut such that there are a plurality of slots (shown generally as 47 on wall 42) communicating through the walls with spacing complimentary to the tabs on the panel 44. The a plurality of reinforcing bar insertion holes communicate through the corrugated plastic on the short stem of the L-shaped panel 44, which faces the interior of the form when the panel 44 is attached to the form side wall.

To place the panel 44 into the form 40, the tabs 46 on the L-shaped panel 44 are inserted into the slots 47 in the side wall 42 or the form 40. Reinforcing bars 45*a* are placed in the reinforcing bar insertion holes in the short stem of the L-shaped panel 44.

Figure 8:
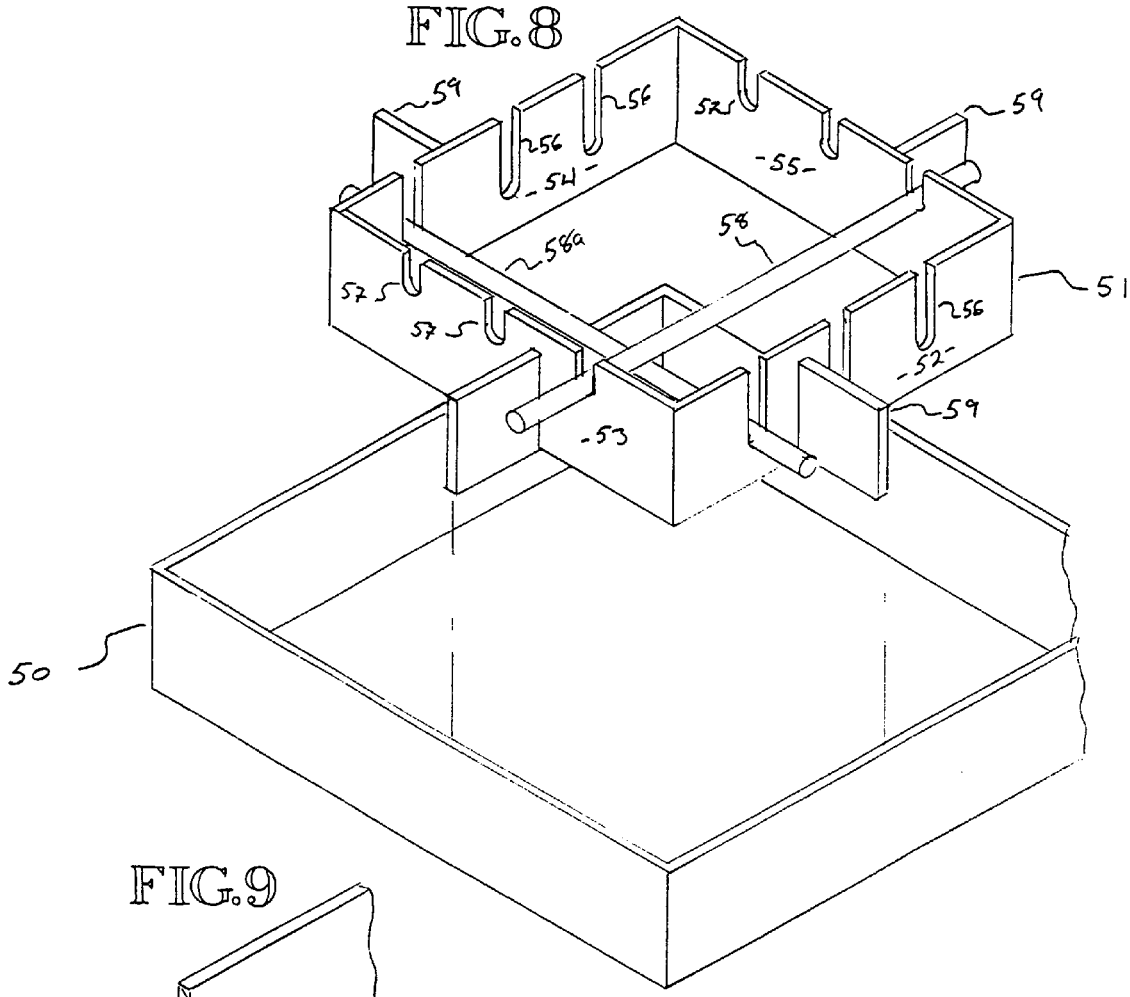
FIG. 8 is an elevated perspective view of a pier block form with another preferred embodiment of a reinforcing bar holder according to the disclosure herein.

FIG. 8 shows another preferred embodiment of a pier block form 50 that is constructed from corrugated plastic and has an reinforcing bar holder 51 that can be placed inside the form 50. The reinforcing bar holder 51 is also constructed from corrugated plastic and it has four side walls 52-55. The side walls 52-55 have reinforcing bar insertion slots 56 & 57 for the insertion of reinforcing bars. The reinforcing bar insertion slots 58 in one pair of opposing side walls 52 & 54, are deeper than the reinforcing bar insertion slots 57 in the other pair of opposing side walls 53 & 55 such that sections of reinforcing bar 58*a* placed in the deeper slots 56 will lie in a plane below the reinforcing bars 58 placed in the shallower slots 57. Spacers 59 are attached to each of the side walls of the reinforcing bar holder 51 to ensure that the reinforcing bar holder 51 is uniformly spaced from the walls of the form 50.

Figure 9:
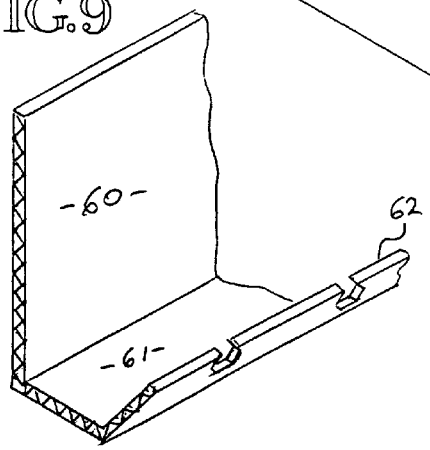
FIG. 9 is a perspective view of a form side wall having a flanged for securing the form in a desired location and for securing reinforcing bar sections within the form according to the disclosure herein.
Figure 10:
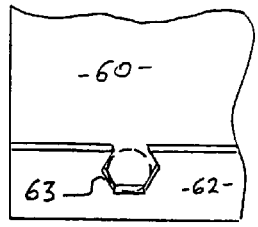
FIG. 10 is a view of a reinforcing bar support notch on the flange shown in FIG. 9.

FIG. 9 and FIG. 10 show a sidewall 60 of another embodiment of a pier block form. This embodiment includes a flange 61 that is located along the bottom edge of the side wall 60 and a reinforcing bar supporting portion 62 that is attached to the flange. The flange 61 can be a separate piece of corrugated plastic that is attached to the side wall 60 or it can be part of the same piece of corrugated plastic that forms the side wall and be defined by a fold/seam at the bottom of the side wall. The flange can have an anchor stake hole communicating therethrough for insertion of an anchor stake to secure the form in a desired location on a construction site.

The reinforcing bar supporting portion 62 can be a separate piece of corrugated plastic that is attached to the flange 61, or it can be part of the same piece of corrugated plastic that forms the flange and be defined by a fold/seam in the flange. A plurality of notches 63 are evenly spaced along the reinforcing bar supporting portion 62 for placement of reinforcing bars within the notches.

Although not depicted in the drawings, there are numerous additional means that can be used for securing reinforcing bars within the various embodiments of the pier block forms of the current invention. Although not exhaustive, other means for securing reinforcing bars within the forms of the current invention can include holes or slots in the side walls of the forms, clips made from metal or other material that hang down from the top edges of the side walls or are inserted into holes in the side walls, and flanges similar to the flange show in FIGS. 9 and 10 that have reinforcing bar insertion holes and are located at the top edge of the side walls.

While the embodiments of the pier block forms depicted in the drawings generally show slots, tabs, or other means for securing two or three sections of reinforcing bars, the drawings are not intended to limit the number of sections of reinforcing bar that can be held in a pier block form by any of these means. The number of sections of reinforcing bars held in any embodiment of the form can also vary based on the size of the form.

Shown in FIG. 12 is another alternative preferred embodiment of the current invention wherein the form 80 is cylindrical in shape with a reinforcing bar holder 81 for placing reinforcing bars within the interior of the form Cylindrical pier block forms of the current invention can be prefabricated and shipped as cylindrical shaped forms or they can comprise a single strip of corrugated plastic having tabs and slots (similar to the tabs and slots for the reinforcing bar panel and form wall shown in FIG. 7) so that the ends of the strip can be joined to create a cylindrical form. The strips of these embodiments can be scored at evenly spaced locations along the long axis of the strip to provide slots, so that the size of the form can be adjusted. Additionally, if a larger cylindrical form is desired, two of the strips can be joined together.

FIG. 11 depicts a form 70 according to the current invention that is formed from a single, elongated piece of corrugated plastic. The piece of corrugated plastic will have folds/seams along the long axis for defining the form side walls, and the form can include means for securing reinforcing bars within the form and means for securing the form in a desired location on a construction site.

One end of the long axis of the form 70 is cut such that it has a plurality of square or rectangular shaped tabs 74 and the other end of the form is cut such that it has a plurality of notches 75 that are complimentary in size and location to the tabs 74. In this embodiment, the integral interconnecting ribs of the corrugated plastic are parallel to the short axis of the form such that when the tabs 74 are inserted into the notches 75, a stake 73 can be placed into the space between the integral interconnecting ribs of the corrugated plastic at the end of a piece of corrugated plastic having the notches, through the space between the integral interconnecting ribs of the corrugated plastic of the tab portions, and into the substrate beneath the form.

While the forms of the current invention have been generally shown or described as being constructed from a single piece of corrugated plastic, they can be constructed from a plurality of pieces of corrugated plastic as well. When the forms are constructed from a plurality of pieces of corrugated plastic, the ends of the pieces can be connected using an adhesive material such as construction glue or the like.

The pieces of corrugated plastic can also have tabs on one end and slots on the other end (a vertical version of the tab and slot type that is show horizontally in FIG. 7) such that the tabbed end of one piece of plastic is connected to the slotted end of another piece of corrugated plastic.

Another connection means comprises slots at each end of the piece of corrugated plastic where the first slot at one end runs from the top edge of the form to the middle of the form and the second slot at the other end runs from the bottom edge of the form to the middle of the form. The form is then assemble by aligning the slotted ends such that a second slot is directly above a first slot and pushing down on the second slotted end. When forms are constructed from multiple pieces of corrugated plastic, each side wall can be constructed from a separate piece of corrugated plastic, or the pieces of corrugated plastic can have folds/seams for defining multiple side walls.

To use the various embodiments of the forms of the current invention, the substrate at a construction site is prepared for constructing a foundation and pier blocks. Desired locations are selected for the pier blocks, and the forms are assembled. The forms are then placed in the desired location and if reinforcing bars are desired, but not already in the form, they can be placed within the form. If desired, the form can be secured in the desired location using means described herein, or other means. Concrete is then poured into the forms, and the pier blocks are allowed to cure.

The forms disclosed in the current invention are constructed from corrugated plastic. They are lightweight, easily transported, easily stored, easily assembled, and easily used. They are less expensive than forms constructed from wood, and they are moisture resistant, unlike forms constructed from cardboard, so they can be left in position for a long period of time before concrete is poured. While they can be reused, the forms disclosed in the current invention do not attract insects, so if time is of the essence in finishing the construction project, there is no need to remove the forms from the finished pier blocks.

The forms of the current invention can include means for securing reinforcing bars in place while pouring concrete and at least one preferred embodiment includes holes for securing the form in its desired location on the construction site. These forms can be constructed such that it is made from a single piece of corrugated plastic material or other preferred embodiments can be constructed from a plurality of pieces of plastic material. At least one embodiment of the current invention can be adjusted such that it is suitable for constructing pier blocks of various sizes.

INDUSTRIAL APPLICABILITY

The invention has applicability in the field of construction using concrete. In particular the current invention describes a number of embodiments of forms for foundation pier blocks. The forms disclosed herein are constructed from corrugated plastic and they are lightweight, easily transported, easily stored, easily assembled, and easily used. They are less expensive than forms constructed from wood, and they are moisture resistant, unlike forms constructed from cardboard.

To use the current invention, a builder simply assembles the forms at the construction site by either folding the one piece forms into the desired shape, or using the tabs and slots to assemble the multi-pieced forms into the desired shape. If desired the forms can be staked to the ground at their desired location and reinforcing bars can be positioned in the forms using the appropriate reinforcing bar holding means. Concrete is then poured into the forms and allowed to set. While the forms disclosed herein can be removed and reused, they do not attract insects, so they do not have to be removed from the finished pier blocks.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

What is claimed is:

1. A form for constructing concrete pier blocks comprising:

four substantially planar side walls made from corrugated plastic having spaced, integral interconnecting ribs between two facing sheets of plastic;

each side wall having a first end, a second end, an interior surface, an exterior surface, a top edge, and a bottom edge;

the first end of each side wall being immediately adjacent to the second end of another of the side walls such that a corner is formed at each end of the side walls, thereby defining a form interior for the placement of concrete and an exterior; and each side wall having a plurality of scored areas such that the scored areas form reinforcing bar tabs and each of the reinforcing bar tabs being further scored for a reinforcing bar insertion hole;

whereby the reinforcing bar tabs can be pushed into the interior of the form and the corrugated plastic can be removed from the scored area on the reinforcing bar tabs thereby forming the reinforcing bar insertion hole on each reinforcing bar tab and the ends of the sections of the reinforcing bars can be placed in the reinforcing bar insertion holes such that the sections of the reinforcing bars extend across the interior of the form at generally right angles to two of the side walls and generally parallel to the other two side walls.

2. The form of claim 1 wherein at least two of the side walls further have an additional scored area such that the scored area forms a anchor stake tab and the anchor stake tab is further scored for a anchor stake insertion hole;

whereby the anchor stake tabs can be pushed to the exterior of the form and the corrugated plastic can be removed from the scored area on the anchor stake tabs thereby forming a anchor stake insertion hole on each anchor stake tab and the anchor stake can be placed in the anchor stake insertion holes and used to secure the form in a desired location at a construction site.

3. The form of claim 1 wherein the form comprises one piece of corrugated plastic having spaced, integral interconnecting ribs between two facing sheets of plastic;

the piece of corrugated plastic having a long axis, a short axis, and two ends;

the piece of corrugated plastic further having three seams at right angles to the long axis whereby the seams define the four side walls of the form; and the ends of the piece of corrugated plastic are connected to each other by an adhesive.

4. The form of claim 1 wherein sections of reinforcing bar can be placed in the reinforcing bar insertion holes on the reinforcing bar tabs before the form is taken to a construction site; and the form can be folded flat and stacked with other forms while the sections of the reinforcing bar are in the form.

5. The form of claim 1 wherein the four side walls define a generally square interior and when sections of reinforcing bar are placed in the reinforcing bar insertion holes on the reinforcing bar tabs and concrete is poured into the form, the hydrostatic pressure exerted on the side walls by the concrete causes uniform deformation in the side walls such that the generally square form assumes a circular shape, while the reinforcing bars remain in their desired location; and the resulting pier block is circular in shape.

6. A method for constructing a concrete pier block comprising the steps of:

(a) selecting a location for constructing the pier block;

(b) preparing the location for construction of the pier block;

(c) selecting a form for construction of the pier block that comprises at least one substantially planar side wall made from corrugated plastic having spaced, integral interconnecting ribs between two facing sheets of plastic, each side wall having a long axis, a short axis, a first end, a second end, an interior surface, an exterior surface, a top edge, and a bottom edge, at least one side wall having at least one scored area such that the scored area forms a reinforcing bar tab and each of the reinforcing bar tabs being further scored for a reinforcing bar insertion hole;

(d) placing the form in the selected location;

(e) rotating said tab into the interior of the form;

(f) inserting the reinforcing bar through the reinforcing bar insertion hole on each reinforcing bar tab;

(h) pouring concrete into the form; and (g) allowing the concrete to harden.

7. The method of claim 6 wherein the form that is placed in the selected location further comprises at least two of the side walls further having an additional scored area such that the scored area forms a anchor stake tab and the anchor stake tab is further scored for a anchor stake insertion hole; and securing the form in the selected location by pushing the anchor stake tabs to the exterior of the form and the corrugated plastic can be removed from the scored area on the anchor stake tabs thereby forming a anchor stake insertion hole on each anchor stake tab and an anchor stake can be placed in the anchor stake insertion hole and used to secure the form in a desired location at a construction site, after the step of placing the form in the selected location and before the step of pouring the concrete into the form.

8. A form for constructing concrete pier blocks comprising:

four substantially planar side walls made from corrugated plastic having spaced, integral interconnecting ribs between two facing sheets of plastic;

each side wall having a first end, a second end, an interior surface an exterior surface, a top edge, and a bottom edge;

the first end of each side wall being immediately adjacent to the second end of another of the side walls such that a corner is formed at each end of the side walls, thereby defining a form interior for the placement of concrete and an exterior; and at least one side wall having a plurality of scored areas such that the scored areas form anchor stake tabs and each of the anchor stake tabs being further scored for a anchor stake insertion hole;

whereby the anchor stake tabs can be pushed out to the exterior of the form and the corrugated plastic can be removed from the scored area on the anchor stake tabs thereby forming the anchor stake insertion hole on each anchor stake tab and the ends of sections of the anchor stakes can be placed in the anchor stake insertion holes and used to secure the form in a desired location at a construction site.

9. The form of claim 8 wherein at least two of the side walls further have an additional scored area such that the scored area forms a reinforcing bar tab and the reinforcing bar tab is further scored for a reinforcing bar insertion hole;

whereby the reinforcing bar tabs can be pushed to the interior of the form and the corrugated plastic can be removed from the scored area on the reinforcing bar tabs thereby forming a reinforcing bar insertion hole on each reinforcing bar tab and the reinforcing bar can be placed in the reinforcing bar insertion holes such that the sections of reinforcing bars extend across the interior of the form at generally right angles to two of the side walls and generally parallel to the other two side walls.

10. The form of claim 8 wherein the form comprises one piece of corrugated plastic having spaced, integral interconnecting ribs between two facing sheets of plastic;

the piece of corrugated plastic having a long axis, a short axis, and two ends;

the piece of corrugated plastic further having three seams at right angles to the long axis whereby the seams define the four side walls of the form; and the ends of the piece of corrugated plastic are connected to each other by an adhesive.

11. The form of claim 8 wherein sections of reinforcing bar can be placed in the reinforcing bar insertion holes on the reinforcing bar tabs before form is taken to a construction site; and the form can be folded flat and stacked with other forms while the sections reinforcing bar are in the form.

12. The form of claim 8 wherein the four side walls define a generally square interior and when sections of reinforcing bar are placed in the reinforcing bar insertion holes on the reinforcing bar tabs and concrete is poured into the form, the hydrostatic pressure exerted on the side walls by the concrete causes uniform deformation in the side walls such that the generally square form assumes a circular shape, while the reinforcing bars remain in their desired location; and the resulting pier block is circular in shape.

* * * * *